United States Patent [19]

Link et al.

[11] Patent Number: 4,929,919

[45] Date of Patent: May 29, 1990

[54] TWIN UNIT CIRCUIT BREAKER WITH IMPROVED MAGNET STRUCTURE

[75] Inventors: Donald A. Link, Hubertus; Dean A. Hubbard, Sussex; Michael R. Larsen, Milwaukee, all of Wis.

[73] Assignee: Eaton Corporation, Cleveland, Ohio

[21] Appl. No.: 211,739

[22] Filed: Jun. 27, 1988

[51] Int. Cl.[5] ..... H01H 75/10

[52] U.S. Cl. ..... 335/38; 335/35; 335/23

[58] Field of Search ..... 335/23, 35–41, 335/167, 168, 169, 27

[56] References Cited

U.S. PATENT DOCUMENTS

| | | | |
|---|---|---|---|
| 2,904,655 | 9/1959 | Gelzheiser et al. | 335/35 |
| 2,922,004 | 1/1960 | Miller et al. | 200/88 |
| 3,109,907 | 11/1963 | Dessert et al. | 200/88 |
| 3,134,051 | 5/1964 | Lyon | 317/119 |
| 3,421,123 | 1/1969 | Johnson et al. | 335/35 |
| 3,488,610 | 1/1970 | Powell | 335/23 |
| 3,832,663 | 8/1974 | Gelzheiser | 337/112 |
| 3,959,752 | 5/1976 | Strobel et al. | 335/10 |
| 4,011,420 | 3/1977 | Heft | 200/147 R |
| 4,232,282 | 11/1980 | Menocal | 335/202 |
| 4,431,877 | 2/1984 | Heft et al. | 200/144 R |
| 4,513,268 | 4/1985 | Seymour et al. | 335/35 |
| 4,616,200 | 10/1986 | Fixemer et al. | 335/34 |

*Primary Examiner*—Leo P. Picard
*Assistant Examiner*—Lincoln Donovan
*Attorney, Agent, or Firm*—L. G. Vande Zande

[57] ABSTRACT

A twin unit circuit breaker has a V-shaped stainless steel combination armature pivot and bias spring, a central offset portion on the armature to increase the armature surface area that is substantially uniformly spaced to pole faces of a pole piece, a thin profile connection of an operating spring with a latch lever, and a preformed U-shaped conductor attachable in circuit between a bimetal and a flexible conductor and insertable over a pole piece from one end thereof.

25 Claims, 4 Drawing Sheets

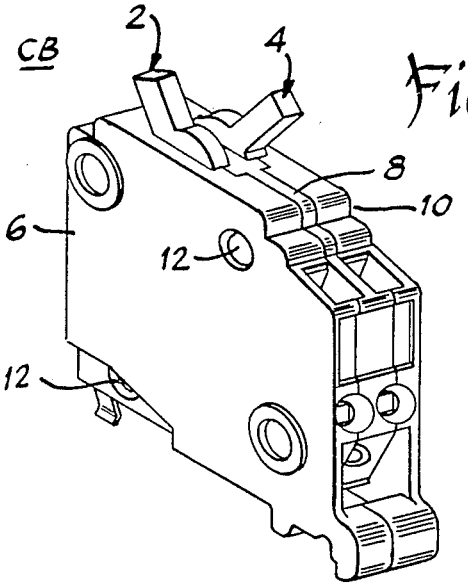
Fig. 1
Fig. 4
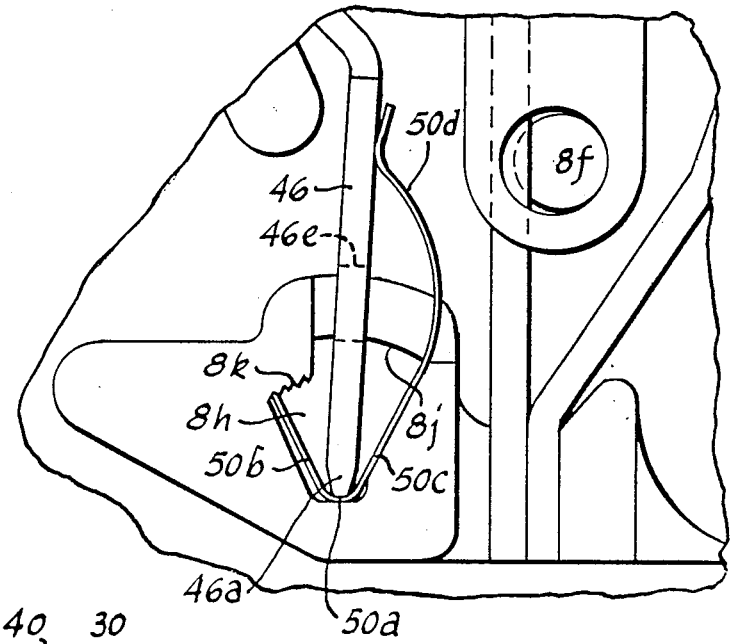
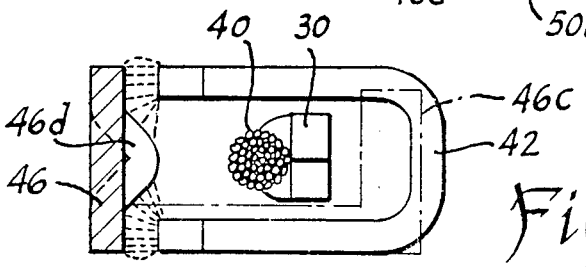
Fig. 5

TWIN UNIT CIRCUIT BREAKER WITH IMPROVED MAGNET STRUCTURE

BACKGROUND OF THE INVENTION

This invention relates to circuit breakers which operate automatically in response to predetermined overload current conditions to separate the contacts of the circuit breaker, thereby opening the circuit in which the predetermined overcurrent condition exists. More specifically, the invention relates to circuit breakers of the aforementioned type having an improved magnet assembly for tripping the circuit breaker to an operated condition in response to predetermined overload currents. Still more particularly, the invention relates to circuit breakers of the aforementioned type in which the operating mechanisms have very narrow transverse dimensions to enable two circuit breaker mechanisms to be assembled as separate side-by-side units within a unitary twin unit molded insulating housing.

It is known to combine a pair of circuit breaker units within a common housing to provide a twin unit circuit breaker. However, although each unit of the resulting twin unit breaker is effectively half size of its singular counterpart, it is intended to handle and interrupt the same current capacities. In particular, the current sensing bimetal and/or magnetic structures in the twin unit breakers, although being reduced in width, are intended to be fully responsive to predetermined overload currents.

SUMMARY OF THE INVENTION

This invention provides an overload current responsive circuit breaker having an improved magnet structure which will operate at low overload current conditions comprising a unitary armature return spring and pivot bearing surface to reduce the armature friction and a specially constructed armature which provides greater surface area thereon adjacent the pole faces of the pole piece for increasing the magnetic flux within the air gaps. An alternative embodiment provides a preformed conductor positioned around the pole piece to provide a multi-turn current path for increasing the flux generated within the magnet system. Other features and advantages of this invention will become more apparent in the following specification and claims when read in conjunction with the accompanying drawings.

BRIEF DESCRIPTION OF THE DRAWINGS

FIG. 1 is an isometric view of a twin unit circuit breaker constructed in accordance with this invention;

FIG. 4 is an enlarged fragmentary view of an armature pivot bearing and return spring shown in FIG. 2;

FIG. 5 is a sectional view taken along the line 5—5 in FIG. 2 showing an armature in cross section and the pole piece in transverse elevation;

DESCRIPTION OF THE PREFERRED EMBODIMENTS

Figure 2:
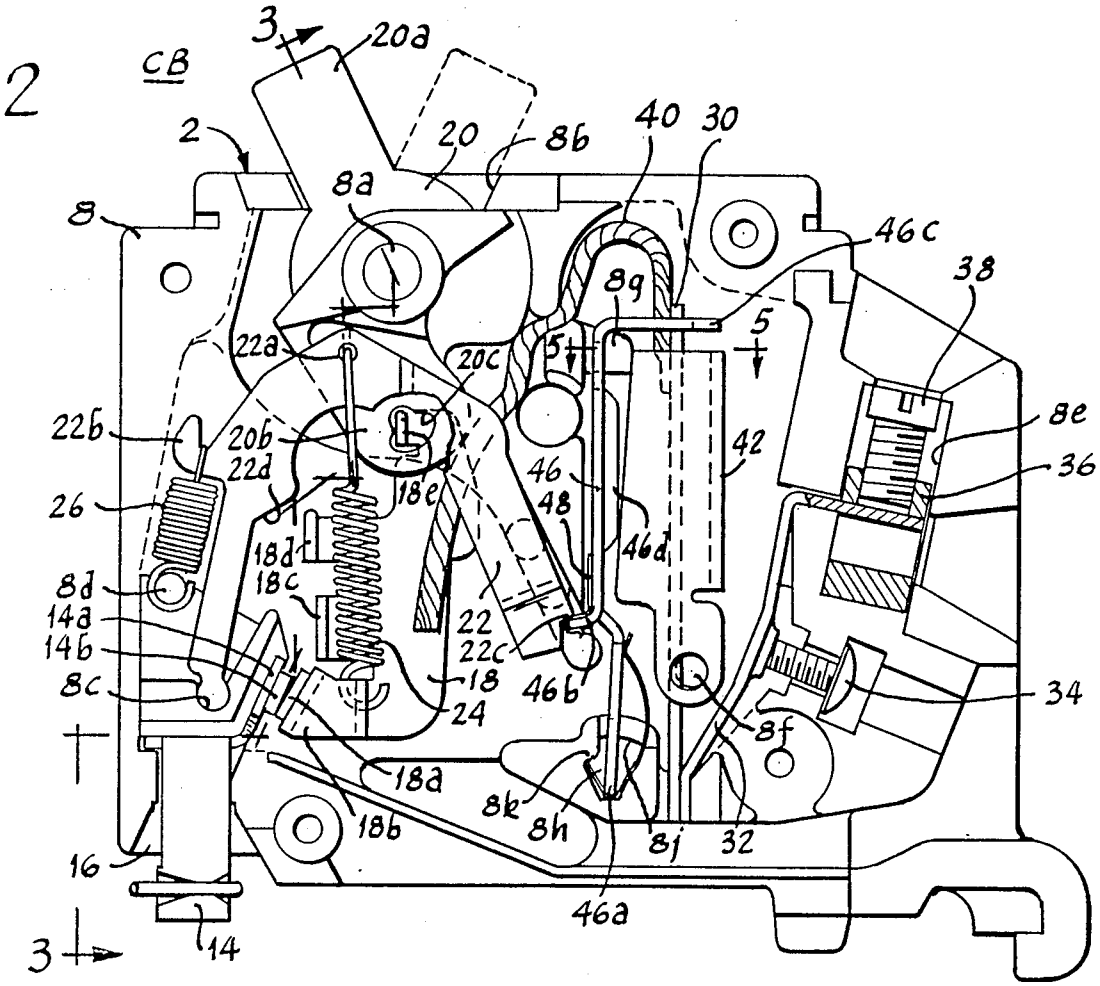
FIG. 2 is a side view of the circuit breaker of FIG. 1 with a near side housing member removed to show the internal mechanism of one unit of the twin unit breaker.
Figure 3:
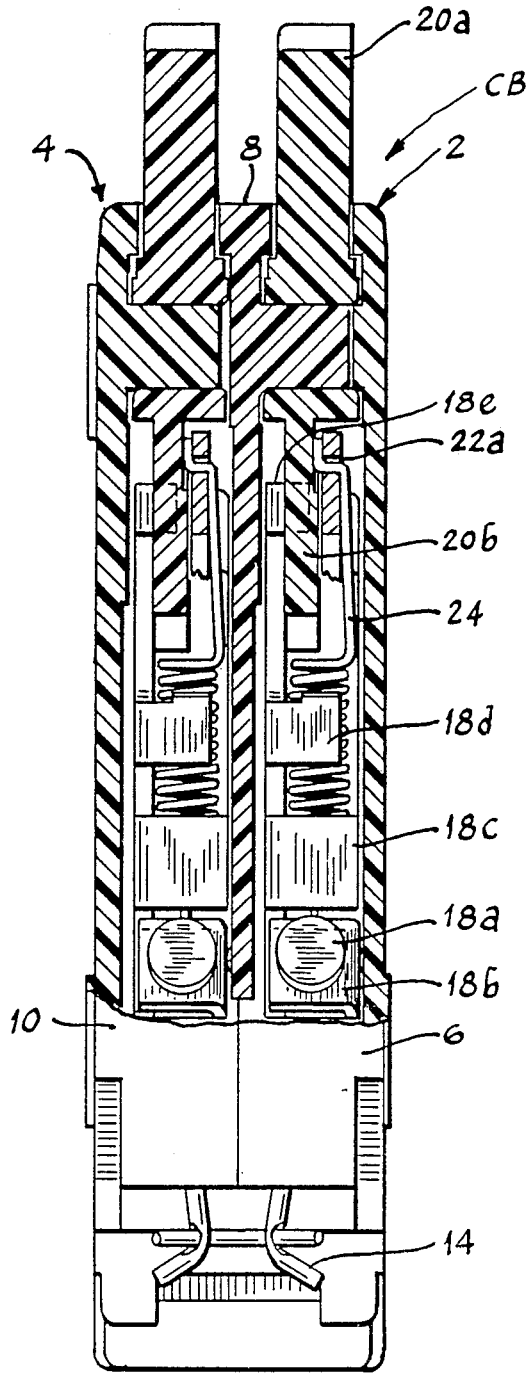
FIG. 3 is a cross sectional view taken along the line 3—3 in FIG. 2.

A twin unit circuit breaker CB constructed in accordance with this invention is shown in FIG. 1. Circuit breaker CB comprises individual circuit breakers 2 and 4 contained within a unitary housing comprising a molded left-hand housing member 6, a center housing member 8 and a right-hand housing member 10 secured together by rivets 12 (FIG. 1). The housing members 6 and 10 have bosses, projections, recesses and the like formed on their interior surfaces to position and mount mechanism components of the individual circuit breaker units. Center housing member 8 is provided with such formations on both sides, the right-hand surface thereof generally corresponding to the formations on the interior side of left-hand housing member 6 and the formations on the left-hand side of center member 8 generally corresponding to the formations formed on the interior surface of right-hand housing member 10. Twin unit circuit breaker CB is arranged for easy assembly wherein component parts of circuit breaker 4 are first assembled within the housing member 10, then center housing member 8 is positioned over those parts onto housing member 10, and subsequent component parts of circuit breaker 2 are assembled in center housing member 8. The left-hand outer housing member 6 is then applied over the component parts of circuit breaker unit 2 onto center housing member 8.

Circuit breaker unit 2 is shown in FIG. 2 with the left-hand outer housing member 6 removed. A combination stationary contact pair and plug-on contact clip 14 is positioned at the lower left-hand corner of circuit breaker CB as viewed in FIG. 2 within an opening 16. Contact clip 14 is essentially T-shaped having a transversely extending upper bar **14*a* which extends into housing cavities for each of the circuit breaker units 2 and 4. Stationary contacts 14*b* are affixed at the ends of bar 14*a* for each of the circuit breaker units. Referring specifically to circuit breaker unit 2 shown in FIG. 2, a planar movable contact arm 18 is positioned against the interior surface of center housing member 8 for cooperation with stationary contact 14*b*. Contact arm 18 has a movable contact element 18*a* affixed to a folded over U-shaped portion 18*b* at the lower end of the contact arm. The contact arm 18 also has a pair of tabs 18*c* and 18*d* formed upwardly at substantially right angles along the left-hand edge thereof. A third tab 18*e* is formed upwardly at a right angle at the upper end of movable contact arm 18 to serve as a pivot for the contact arm 18** as will be described hereinafter.

A molded operator 20 is rotatably journaled on a cylindrical boss **8*a* projecting from an interior surface of center housing member 8. A handle 20*a* of operator 20 projects through an opening in an upper or forward wall of the housing formed by a recess 8*b* in center housing member 8 and a corresponding mating recess in outer housing member 6 for external manual operation of the breaker. Operator 20 has a depending leg 20*b* extending on the opposite side of its rotational axis from handle 20*a*. Leg 20*b* has an aperture 20*c* formed near the distal end thereof which is disposed over tab 18*e* to pivotally attach movable contact arm 18 to operator 20**.

A generally inverted U-shaped latch lever 22 is pivotally mounted at its left-hand end within a semi-cylindrical recess **8*c* in center housing member 8. Latch lever 22 has a small hole 22*a*** formed approximately centrally thereof which receives the Z-shaped offset end of a spring 24. The opposite end of spring 24 comprises a loop shaped hook which is connected to lower portion 18*b* of movable contact arm 18. Spring 24 connects latch lever 22 to movable contact arm 18 under tension, thereby biasing movable contact arm 18 clockwise about its pivotal attachment to operator 20 and biasing latch lever 22 clockwise about the pivot formed by recess 8*c*. In the ON position of breaker 2 shown in FIG. 2, spring 24 provides contact closing force for contacts 14*b* and 18*a*. A second helical tension spring 26 is connected between a boss 8*d* of center housing member 8 and a hook 22*b* formed on the left-hand leg of latch lever 22 in opposition to the bias provided by spring 24. Spring 26 is operable to automatically reset latch lever 22 and the breaker mechanism after the breaker has tripped and to move handle 20*a* to the OFF position. When the circuit breaker 2 is in its ON state as depicted in FIG. 2, spring 26 is almost fully relaxed, providing little opposing bias to latch lever 22. However, when the circuit breaker 2 trips and latch lever 22 moves in a clockwise direction about pivot 8*c*, spring 26 becomes stretched to provide a reverse or counterclockwise bias to latch lever 22 as will be described more fully hereinafter, thereby urging latch lever 22 back to a reset position.

A current sensing bimetal and magnet structure assembly is located in the right-hand portion of the circuit breaker assembly. A bimetal member 30 is affixed at one end such as by welding, soldering or the like, to a support member 32 which is positioned against an end wall structure of center housing member 8 at the right-hand side of the breaker by a screw 34. Bimetal member 30 stands essentially upright within the cavity of circuit breaker unit 2 in the orientation shown in FIG. 2, supported at its lower end by its attachment to support member 32. By turning screw 34 clockwise, support 32 is threaded to the right on screw 34 to bow the support member 32 inward about spaced points of support on the end wall, thereby to deflect the lower end thereof and rotate the upper end of bimetal 30 in a clockwise direction. The adjustable positioning of the upper end of bimetal 30 in this manner calibrates the predetermined current at which the breaker will trip. The upper end of support member 32 extends through an opening in the end wall structure of the breaker to receive a rectangular wiring terminal 36 thereover, the terminal 36 being captively held for sliding movement within a pocket 8*e* and a corresponding mating pocket in outer housing member 6. Terminal 36 has a set screw 38 threadably engaged therein for clamping a wire (not shown) from a branch circuit to the circuit breaker 2.

A flexible braided conductor 40 is affixed to the upper or free end of bimetal member 30 by soldering, welding, brazing or the like. The opposite end of braided conductor 40 is similarly affixed to the planar portion of movable contact arm 18. The magnetic structure for the circuit breaker 2 comprises an elongated pole piece 42 having a U-shaped cross section pivotally mounted at its lower end on a cylindrical boss 8*f* projecting from the left-hand interior surface of center housing member 8 and a corresponding mating cylindrical boss (not shown) projecting from the interior surface of housing member 6, and an armature 46 pivotally mounted within the housing in a manner to be described more fully hereinafter. Pole piece 42 has enlarged circular holes 42*a* in each leg at the lower end thereof to be disposed over the respective cylindrical projections 8*f* and its corresponding boss on housing member 6. The upper end of pole piece 42 is afforded limited counterclockwise movement by engagement thereof with a boss 8*g* on the left-hand surface of center housing member 8 and a corresponding boss on the interior surface of outer housing member 6.

Figure 6:
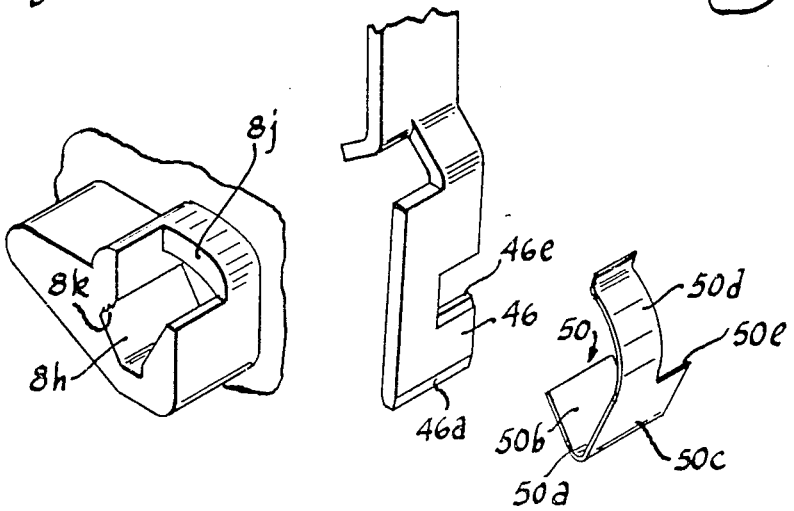
FIG. 6 is an exploded isometric view of an armature pivot bearing and return spring, part of a housing member and an armature shown in FIG. 4.

Housing member 8 has a triangular pocket 8*h* formed near a lower edge thereof. Referring particularly to FIGS. 2, 4 and 6, an upper side of triangular pocket 8*h* comprises a recessed arcuate wall 8*j* and a short segment containing serrations 8*k*. A combined bearing member and armature return spring 50 is formed from a strip of stainless steel or other suitable spring material into a V-shaped member which is pressed into pocket 8*h*. Spring 50 has a smooth arcuate center trough 50*a* from which a pair of legs 50*b* and 50*c* diverge. Leg 50*c* is relieved along the back edge thereof and extends past arcuate surface 8*j* to form an armature return spring portion 50*d* and a short transverse ledge 50*e* (FIG. 6). Leg 50*c* rests flush against the right side of pocket 8*h* with the ledge 50*e* abutting the under surface of wall 8*j*. Leg 50*b* is self sprung outwardly from leg 50*c* within pocket 8*h*, the upper end of leg 50*b* engaging serrations 8*k* to force the arcuately formed juncture of legs 50*b* and 50*c* firmly against the bottom pocket 8*h* and to hold leg 50*c* against the right side of pocket 8*h*, thereby positively locating the arcuate trough 50*a*, and hence the armature pivot, within the housing. Return spring 50*d* is arcuately formed to reverse its direction to that of leg 50*c* from which it extends. Armature 46 has a blade edge pivot 46*a* formed along the extreme lower end thereof. Blade edge pivot 46*a* is positioned within the arcuate trough 50*a* of stainless steel bearing member 50 to provide a low friction bearing surface for the armature. The rear edge of armature 46 is notched at 46*e* (FIGS. 4 and 6) to provide clearance for recessed arcuate wall 8*j* of the upper side of triangular pocket 8*h*. When the armature 46 is positioned within bearing trough 50*a*, spring 50*d* bears against the right-hand surface of the armature 46 as seen in FIGS. 2 and 4 to bias the armature counterclockwise about the blade edge pivot 46*a*.

Armature 46 has a stepped offset intermediate its ends and a latch tab 46*b* is formed to extend leftward at the offset as viewed in FIG. 2. A stainless steel clip 48 is affixed to armature 46 over latch tab 46*b* to provide a hard, smooth and consistent latching surface received by a notch 22*c* at the right-hand end of latch lever 22. The upper end of armature 46 is formed at right angles to the major portion of the body thereof to provide an L-shaped hook 46*c* which extends to the right-hand side of bimetal member 30. Bimetal member 30 will abut hook 46*c* when the bimetal member moves to the right to pull the armature 46 away from latch lever 22 and effect release of latch lever 22. The upper main body portion of armature 46 is provided with an offset portion 46*d* protruding toward pole piece 42. Offset portion 46*d* is disposed centrally of the lateral edges of armature 46 and is elongated in the vertical direction, which corresponds to the direction of elongation of pole piece 42. Centrally offset portion 46*d* is disposed to fit between the legs of pole piece 42 when armature 46 is attracted against pole faces formed on the outer ends of the legs of pole piece 42.

In operation, current from a supply source is fed to the circuit breaker 2 through terminal 14 and stationary contact 14*b* to movable contact 18*a*, movable contact arm 18, braided flexible conductor 40, bimetal 30, support conductor 32 and wiring terminal 36 to a wire leading to a branch circuit which is to be protected by the circuit breaker. In the event of a prolonged, low grade fault current condition, bimetal 30 will heat due to the overcurrent and is selected to deflect to the right in response to its heated condition. Thus, as mentioned previously, bimetal 30 will engage the hook 46c to pull armature 46 clockwise about the blade edge pivot 46a, thereby pulling latch tab 46b and the latching surface provided by stainless steel spring 48 from engagement with notch 22c of latch lever 22. When so released, latch lever 22 pivots clockwise about the pivot 8c under the influence of spring 24. Clockwise movement of latch lever 22 carries the upper end of spring 24 across the plane of the pivot connecting operating handle 20 and movable contact arm 18 formed by tab 18e and aperture 20c to effect counterclockwise movement of movable contact arm 18 about this pivotal connection, thereby separating the movable contact 18a from the stationary contact 14b. The aforedescribed movement of contact arm 18 foreshortens the operating length of spring 24, relaxing it to a nearly solid condition having its line of action directed to the left of the pivot of operator 20, thereby applying a clockwise moment to the operator 20. Thereafter, spring 26 urges latch lever 22 counterclockwise to its reset position, moving contact arm 18 and spring 26 therewith. Spring 24 then becomes fully relaxed and acts as a solid link to rotate operating handle 20a to a right-hand OFF position of the circuit breaker as shown in dotted lines in FIG. 2. Tab 18c is disposed at the left-hand side of spring 24 to protect the spring against any arcing that occurs upon separation of the contacts. Tab 18d is disposed to be struck with a hammer-like blow by a surface 22d on latch lever 22 to jar the the contacts 14b–18a apart in the event that they may not have separated.

When bimetal 30 cools and returns to its original, normal position, armature 46 rotates counterclockwise about pivot 46a in trough 50a to bring the latching surface into engagement with notch 22c, thereby to relatch the breaker mechanism. Subsequent movement of handle 20a leftward to the ON position carries the pivot connection 20c/18c of operator 20 and contact arm 18 over-center of the line of action of spring 24, thereby closing movable contact 18a upon stationary contact 14b.

In the event of a sudden large increase in current flow through the circuit breaker, the magnetic structure takes over to rapidly trip the circuit breaker before the bimetal 30 has a chance to respond to the increased current. Current flow through the bimetal member and the braided conductor 40 induces a magnetic flux within the U-shaped pole piece 42, thereby to attract armature 46 to the pole faces of pole piece 42. Initial attraction causes pole piece 42 to rotate counterclockwise against limit boss 8g; thereafter armature 46 moves toward pole piece 42. Armature 46 pivots clockwise about the blade edge pivot 46a to move the latching surface away from the notch 22c and release the latch lever 22 as previously described. The central offset portion 46d enhances the flux pattern on the armature established within the gap between the armature and the pole faces of pole piece 42. As best seen in FIG. 5, the offset portion 46d is angularly offset in cross section to substantially increase the amount of surface of armature 46 which comprises the magnetic gap with the pole faces of pole piece 42. As a result, an increased area of magnetic flux pattern in the armature causes the armature 46 to be attracted to the pole piece 42 at lower fault current conditions.

Figure 7:
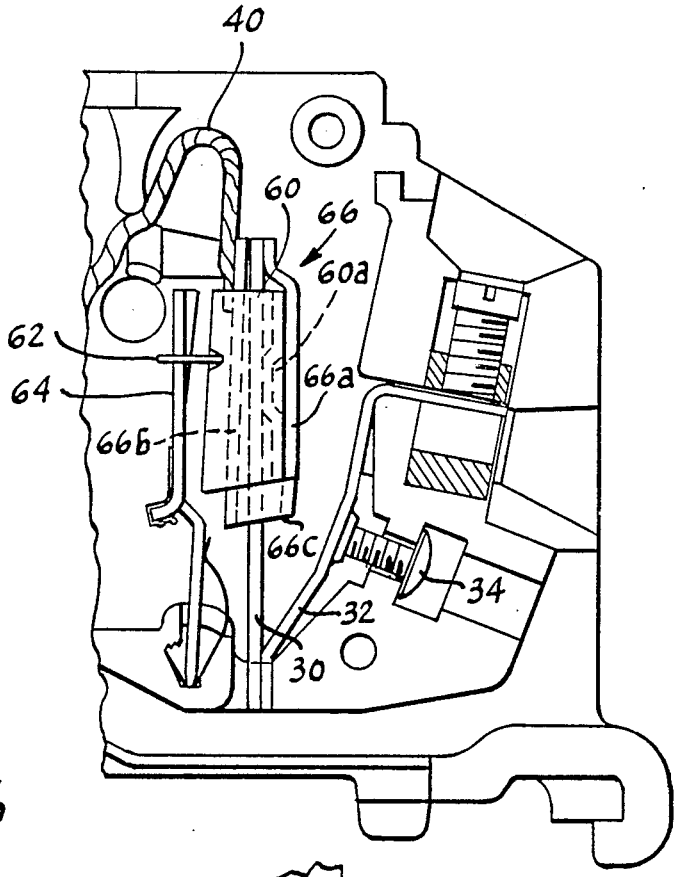
FIG. 7 is a partial view similar to FIG. 2, but showing a modified form of pole piece and current conductors.

An alternate embodiment of magnet structure is shown in FIG. 7. Reference numerals for parts previously described and common to the breaker illustrated in FIG. 7 have been repeated. A bimetal member 30 is supported within an insulating housing by a support strap 32 and a screw 34. An elongated pole piece 60 having a U-shaped cross section is affixed directly to the bimetal member intermediate the opposite ends thereof. The bight portion of pole piece 60 is offset inwardly into the area between the legs of the pole piece to provide a welding surface 60a for attachment of the pole piece to the bimetal member 30. A wire bail 62 is connected within openings in the outer ends of the legs of pole piece 60 to encircle the armature 64 to thereby carry the armature away from the latch lever 22 when the bimetal deflects to the right in response to overcurrent conditions. A preformed substantially U-shaped flat conductor 66 is provided on pole piece 60 to form a double turn current path around the pole piece. Legs 66a and 66b of the preformed conductor 66 are generally wide flat members of thin cross section which are disposed with their wide faces in parallel facing orientation. The upper or free end of leg 66a is offset to the left beyond the upper end of pole piece 60 to be secured against the right-hand surface of the free end of bimetal 30. Leg 66a extends down alongside the bight portion of pole piece 60 in flat facing spaced relationship thereto to the opposite, or lower end of pole piece 60. The bight portion 66c of preformed conductor 66 extends around the near side of bimetal 30, connecting the legs 66a and 66b together along the narrow lower edges thereof. Leg 66b extends along the left-hand side of bimetal 30 in flat facing spaced relationship thereto beyond the upper end of pole piece 60, whereat it is connected by soldering, welding or the like to the braided conductor 40. The preformed conductor 66 forms a double turn current path around the pole piece for enhancing the magnetic flux induced by current flow through the circuit breaker. The particular flat preformed construction of conductor 66 enables a double turn to be provided in a very narrow width structure.

In the embodiment shown in FIG. 7, it can be seen that the central offset portion 64a on armature 64 is tapered in a decreasing amount of offset toward the pivot end of the armature. This is in contrast to the straight offset portion 46d of armature 46. The tapered offset in the FIG. 7 embodiment more closely matches the orientation of the pole faces and therefor maintains the magnetic gap distance from the pole faces to the armature more nearly equidistant throughout the length.

Although the invention has been described in its preferred embodiments, it is to be understood that it is susceptible of various modification without departing from the scope of the appended claims.

We claim:

1. A current responsive circuit breaker comprising:

an insulating housing;

a stationary contact mounted in said housing;

a movable contact in said housing engagable with said stationary contact;

magnetic current sensing means in said housing comprising a pole piece having a pair of pole faces thereon and an armature pivotally mounted in spaced proximity to said pole faces, said armature being movable into engagement with said pole faces;

means operable to effect separation of said movable contact from said stationary contact in response to movement of said armature toward engagement with said pole faces; and metallic bearing means mounted in said housing, said bearing means having a smooth surface trough and said armature having a blade edge pivot received in said trough.

2. The current responsive circuit breaker as defined in claim 1 wherein said metallic bearing means comprises a metal strip having an arcuate trough portion and a pair of diverging legs extending from said trough portion, and said housing comprises a pocket in which said strip is resiliently entrapped.

3. The current responsive circuit breaker as defined in claim 2 wherein one of said diverging legs comprises a spring portion extending beyond said pocket, said spring portion including means engaging said armature biasing said armature away from said pole faces.

4. The current responsive circuit breaker as defined in claim 2 wherein one of said diverging legs comprises a spring portion extending beyond said pocket, said spring portion being formed in a reverse direction to a divergence angle of said one leg to abut said armature, said spring portion biasing said armature away from said pole faces.

5. The current responsive circuit breaker as defined in claim 4 wherein said pocket is substantially triangular and comprises serrations on one side thereof engaged by a distal end of an other of said diverging legs when said other leg is spread away from said one leg, thereby retaining said bearing means securely positioned in said pocket.

6. The current responsive circuit breaker as defined in claim 2 wherein said metallic bearing means comprises stainless steel strip.

7. A current responsive circuit breaker comprising:

an insulating housing;

a stationary contact mounted in said housing;

a movable contact in said housing engagable with said stationary contact;

magnetic current sensing means in said housing comprising:

an elongated pole piece having a U-shaped cross section mounted in said housing, free ends of legs of said pole piece providing elongated pole faces;

electrically conductive means extending through said pole piece between said legs thereof, current in said conductive means inducing a magnetic field in said pole piece;

an armature mounted in spaced proximity to said pole faces and being movable to engage said faces, said armature having an offset central portion protruding toward said pole piece and disposed between said legs of said pole piece when said armature engages said pole faces, said offset portion providing an increased area on said armature which is substantially uniformly spaced from said pole faces, thereby to increase a flux pattern on said armature at magnetic gaps between said armature and said pole faces; and means operable to effect separation of said movable contact from said stationary contact in response to movement of said armature toward said pole faces.

8. The current responsive circuit breaker as defined in claim 7 wherein said offset central portion is elongated in a direction corresponding to elongation of said pole piece.

9. The current responsive circuit breaker as defined in claim 8 wherein said armature is pivotally movable into engagement with said pole faces and said central offset portion is tapered to reduce the amount of protrusion of said offset portion in a direction toward a pivot of said armature.

10. A current responsive circuit breaker comprising:

an insulating housing;

a stationary contact mounted in said housing;

a movable contact in said housing engagable with said stationary contact;

electrically conductive means mounted in said housing;

an elongated pole piece having a U-shaped cross section carried by said conductive means, a bight portion of said pole piece being affixed to said conductive means and legs of said pole piece being disposed on opposite sides of said conductive means, free ends of said legs providing pole faces;

an armature mounted in spaced proximity to said pole faces and movable into engagement therewith;

means operable to effect separation of said movable contact from said stationary contact in response to movement of said armature toward said pole faces;

a substantially U-shaped preformed conductor disposed around said pole piece, a first leg of said preformed conductor being attached at a free end thereof to said conductive means at one end of said pole piece, said first leg extending along said bight portion of said pole piece in spaced relation thereto beyond an opposite end of said pole piece, a bight portion of said preformed conductor extending around said conductive means in spaced relation thereto, a second leg of said preformed conductor extending from said bight portion thereof between said legs of said pole piece, a free end of said second leg extending beyond said one end of said pole piece; and a flexible conductor attached to said free end of said second leg and to said movable contact.

11. The current responsive circuit breaker as defined in claim 10 wherein said first and second legs of said U-shaped preformed conductor comprise substantially wide flat members relative to the thickness thereof and are oriented with wide surfaces in parallel facing relationship, said wide surfaces also being in parallel facing relationship with said bight of said pole piece, and wherein said bight portion of said preformed conductor is oriented perpendicularly to said wide surfaces, connected between narrow edges of said first and second legs.

12. The current responsive circuit breaker as defined in claim 10 wherein said conductive means comprises a bimetal member which deflects away from said armature in response to predetermined current flow therein, and said pole piece comprises means engagable with said armature when said bimetal deflects a predetermined amount to move said armature in response to bimetal deflection.

13. The current responsive circuit breaker as defined in claim 10 wherein said armature has a central portion offset toward said pole piece, said offset portion being disposed between said legs of said pole piece when said armature engages said pole faces, said offset portion providing an increased area on said armature which is substantially uniformly spaced from said pole faces, thereby to increase a flux pattern on said armature at magnetic gaps between said armature and said pole faces.

14. The current responsive circuit breaker as defined in claim 11 wherein said armature is pivotally movable into engagement with said pole faces and said central offset portion is tapered to reduce the amount of protrusion of said offset portion in a direction toward a pivot of said armature.

15. The current responsive circuit breaker as defined in claim 10 wherein said armature has a blade edge pivot and said housing has a substantially triangular pocket in which a combined armature spring and armature pivot bearing member is resiliently entrapped, said member comprising a metal strip having an arcuate trough portion receiving said blade edge of said armature and a pair of diverging legs extending from said trough portion, one of said legs having a spring portion extending beyond said pocket and formed in a reverse direction to a divergence angle of said one leg to abut a surface of said armature and bias it away from said pole faces.

16. In a current responsive circuit breaker having:

an insulating housing having an opening;

an operator rotatably mounted in said housing having a handle projecting through said opening;

a stationary contact mounted in said housing;

a movable contact arm having a pivotal connection at one end to said operator and a contact at an opposite end movable into and out of engagement with said stationary contact as said arm moves about said pivotal connection;

an armature pivotally mounted in said housing, said armature having a latch surface thereon;

a latch lever pivotally mounted in said housing and engaging said latch surface in a first position of said latch lever;

a spring connected between said latch lever and said opposite end of said arm biasing said contact thereof into engagement with said stationary contact;

conducting means electrically connecting said arm to terminal means carried by said housing; and means responsive to predetermined current in said conducting means moving said armature to release said latch lever, said spring moving said latch lever to a second position whereat said spring moves said arm to separate said contact thereof from said stationary contact; the improvement comprising:

metallic bearing means mounted in said housing having a smooth surface trough; and a substantially blade edge pivot on said armature received in said trough.

17. The current responsive circuit breaker as defined in claim 16 wherein said metallic bearing means comprises a metal strip folded in an arcuate bend to provide said smooth surface trough having diverging legs extending from opposite sides and said housing comprises a substantially triangular pocket into which said metal strip is resiliently entrapped.

18. The current responsive circuit breaker as defined in claim 17 wherein one of said diverging legs extends beyond said pocket and is reversely formed over to resiliently abut a surface of said armature, biasing said armature toward said latch lever.

19. The current responsive circuit breaker as defined in claim 18 wherein said triangular pocket comprises serrations in one side thereof, a distal end of an other one of said diverging legs engaging said serrations when said other one of said diverging legs if forcibly spread away from said one leg, thereby forcing said legs against corresponding sides of said pocket and positively locating said trough within said pocket.

20. The current responsive circuit breaker as defined in claim 18 wherein said movable contact arm comprises a planar member movable in its own plane, said movable contact is mounted on a portion of said arm formed over at substantially a right angle to said plane, said spring extends along said planar portion, and said arm further comprises a tab formed over from said planar portion immediately adjacent said movable contact portion and extending between said movable contact and said spring to shield said spring from arcs drawn between said movable and stationary contacts.

21. The current responsive circuit breaker as defined in claim 18 wherein an end of said spring which is connected to said latch lever has a shallow Z-shaped bend offset substantially the amount of material thickness of said latch lever, said offset bend being received in a hole in said latch lever, thereby to minimize transverse space requirements for connection of said spring to said latch lever.

22. The current responsive circuit breaker as defined in claim 18 wherein said means responsive to predetermined currents in said conducting means comprises an elongated pole piece having a U-shaped cross section mounted in said housing, free ends of legs of said pole piece providing elongated pole faces, said legs being disposed on opposite sides of said conducting means, and said armature has an offset portion protruding toward said pole piece and disposed between said pole piece legs when said armature engages said pole faces, said offset portion providing an increased area on said armature which is substantially uniformly spaced from said pole faces, thereby to increase a flux pattern on said armature at magnetic gaps between said armature and said pole faces.

23. The current responsive circuit breaker as defined in claim 22 wherein said offset portion is elongated in a direction corresponding to elongation of said pole faces.

24. The current responsive circuit breaker as defined in claim 18 wherein said means responsive to predetermined current comprises an elongated pole piece having a U-shaped cross section carried by said conducting means, a bight portion of said pole piece being affixed to said conducting means and legs of said pole piece being disposed on opposite sides of said conducting means, free ends of said legs providing pole faces, and a substantially. U-shaped preformed conductor disposed around said pole piece, a first leg of said preformed conductor being attached at a free end thereof to said conducting means at one end of said pole piece, said first leg extending along said bight portion of said pole piece in spaced relation thereto beyond an opposite end of said pole piece, a bight portion of said preformed conductor extending around said conducting means in spaced relation thereto, a second leg of said preformed conductor extending from said bight portion thereof between said legs of said pole piece, a free end of said second leg extending beyond said one end of said pole piece, and a flexible connector attached to said free end of said second leg and to said movable contact.

25. The current responsive circuit breaker as defined in claim 24 wherein said conducting means comprises a bimetal member which deflects away from said armature in response to predetermined current flow therein, and said pole piece comprises means engagable with said armature when said bimetal deflects a predetermined amount to move said armature in response to bimetal deflection.

* * * * *